United States Patent [19]

Blumentritt et al.

[11] Patent Number: 5,015,202

[45] Date of Patent: May 14, 1991

[54] ELECTRIC PLUG CONNECTOR

[75] Inventors: Martin Blumentritt, Königsbronn/Ochsenberg; Reiner Kohler, Aalen; Peter Greve, Essingen, all of Fed. Rep. of Germany

[73] Assignee: Carl-Zeiss-Stiftung, Heidenheim, Fed. Rep. of Germany

[21] Appl. No.: 505,481

[22] Filed: Apr. 6, 1990

[30] Foreign Application Priority Data

Apr. 14, 1989 [DE] Fed. Rep. of Germany ..... 3912236

[51] Int. Cl.[5] ..... H01R 13/00; H01R 4/60

[52] U.S. Cl. ..... 439/487; 439/194; 439/196; 439/933

[58] Field of Search ..... 439/485, 487, 196, 194, 439/933; 165/154, 185

[56] References Cited

U.S. PATENT DOCUMENTS 4,780,799 10/1988 Groh ..... 439/485

FOREIGN PATENT DOCUMENTS 0093079 11/1983 European Pat. Off. .

OTHER PUBLICATIONS

Grosso, C., "Epoxy Coated Devices", Western Electric Technical Digest, No. 56, 10–79, p. 13.

*Primary Examiner*—David L. Pirlot
*Assistant Examiner*—Julie R. Daulton
*Attorney, Agent, or Firm*—Walter Ottesen

[57] ABSTRACT

The invention is directed to an electric plug connector having a cooled connector component on a consumer where an intense heat is generated. The plug connector includes a movable connector component having a flexible supply line and both connector components are configured with heat-contact surfaces which define a low heat resistance when in contact with each other. In the movable connector component, at least one electrical line part is connected to a part made of a good insulating and heat-conductive material. The flow of heat to the heat-contact surface of the movable connector component takes place through this part made of insulating and good heat-conductive material.

8 Claims, 2 Drawing Sheets

ELECTRIC PLUG CONNECTOR

BACKGROUND OF THE INVENTION

Pump sources for high energy lasers must be driven with high electrical energy and therefore become very hot during operation. It is customary to cool the pump sources with water since the heat negatively influences the laser arrangement. The laser rod is often included in the cooling loop.

The service life of the pump sources is limited, and they must be exchanged frequently. For this reason, plug connectors are preferred for the electrical supply lines because they are easily manipulated. In conventional cooling of the pump sources, these plug connectors become very hot which leads to poor contacts and can therefore lead to disruptions in the electrical current supply of the pump sources.

European patent publication No. EP-A1-0 093 079 discloses a single-pole, water-cooled, electric plug connection for electrical arc furnaces wherein the supply and discharge of the cooling water take place through the movable component of the plug connector together with the electrical supply line. The cooling water also flows through the stationary component of the plug connector and therefore cools also the connector locations of the electrical supply line to the electrical arc furnace.

The complex configuration of this known cooled electric connector is a disadvantage. Furthermore, the voltage conducting parts are only partially insulated. Since the pump sources must be exchanged relatively often in lasers, the known plug connector is also unsuitable because of the complicated manipulation associated therewith.

Because of the foregoing, only that component of the plug connector is cooled wherein the pump source is seated in the case of laser arrangements and for other apparatus, where the electrical consumer is seated.

SUMMARY OF THE INVENTION

In view of the above, it is an object of the invention to provide a cooled electric plug connector which is easily detachable, completely insulated and as simple as possible in its configuration and with respect to its manipulation. It is another object of the invention to provide such an electric plug connector wherein the cooling is adequate so that no disturbances can occur in the electrical current supply.

The electric plug connector of the invention is for an apparatus having cooling means for removing heat generated in the apparatus. The plug connector includes: a first component connected to the apparatus and including a heat-conductive first part operatively connected to the cooling means, the heat-conductive first part having a first heat-contact surface formed thereon; first electrical contact means for conducting electrical energy to the apparatus; a second component movable and adapted so as to be connectable to the first component and including a second heat-conductive part made of an electrically-insulating and good heat-conductive material and the second heat-conductive part having a second heat-contact surface formed thereon; the first and second heat-contact surfaces being in mechanical contact with each other when the components are connected to each other so as to conjointly define a heat-transfer interface having a low heat resistance; the first part being configured so as to cause the first part to define a low heat resistance path between the first heat-contact surface and the cooling means; second electrical contact means mounted in the second component for electrically contact engaging the first electrical contact means when the components are connected to each other; and, the second electrical contact means being connected to the second heat-conductive part so as to be in low heat resistance contact therewith.

The cooled connector component can likewise be equipped with a part made of electrically insulating and good heat-conductive material which either is itself configured with the heat-contact surface or which is connected with low heat resistance to a part which has the heat-contact surface formed thereon.

The heat-contact surfaces can be configured as planar surfaces perpendicular to the axis of the plug connector. The heat-contact surfaces can however also be configured as conical surfaces having conical axes which are coincident with the axis of the plug connector.

Plug connectors of this kind are not limited to single-pole embodiments. It is easily possible to mount several contact pairs insulated from each other in the two connector components which, when connected, are inserted one into the other to thereby provide a multi-pole connection.

Commercially available material can be used for the components which are electrically insulating while having good heat-conductive qualities. Such a material is available commercially under the trade name AIN from the ANCeram Company located at 8589 Bindlach in the Federal Republic of Germany.

The machining or processing of the surfaces of the heat-contact surfaces is the decisive factor for a good heat transfer between these heat-contact surfaces. The machining of these surfaces should in the optimal situation be such that the heat-contact surfaces adhere to each other by adhesion when brought together. This is known as optical polish in optics when referring especially to the machining of glass surfaces. A corresponding surface treatment is also known for precision sizes made of metal which are wrung together.

The heat-contact surfaces therefore hold together by themselves if they are adequately well machined and are brought sufficiently close together. The foregoing notwithstanding, one or more springs or threaded fasteners or other known means are advantageous for bringing the heat-contact surfaces sufficiently close together and for securing the connection.

It is an advantage of the invention that the heat-contact surfaces are configured so as to be resistant to high voltage by providing appropriate dimensions for the corresponding parts.

BRIEF DESCRIPTION OF THE DRAWINGS

The invention will now be described with reference to the drawings wherein.

DESCRIPTION OF THE PREFERRED EMBODIMENTS OF THE INVENTION

Figure 1A:
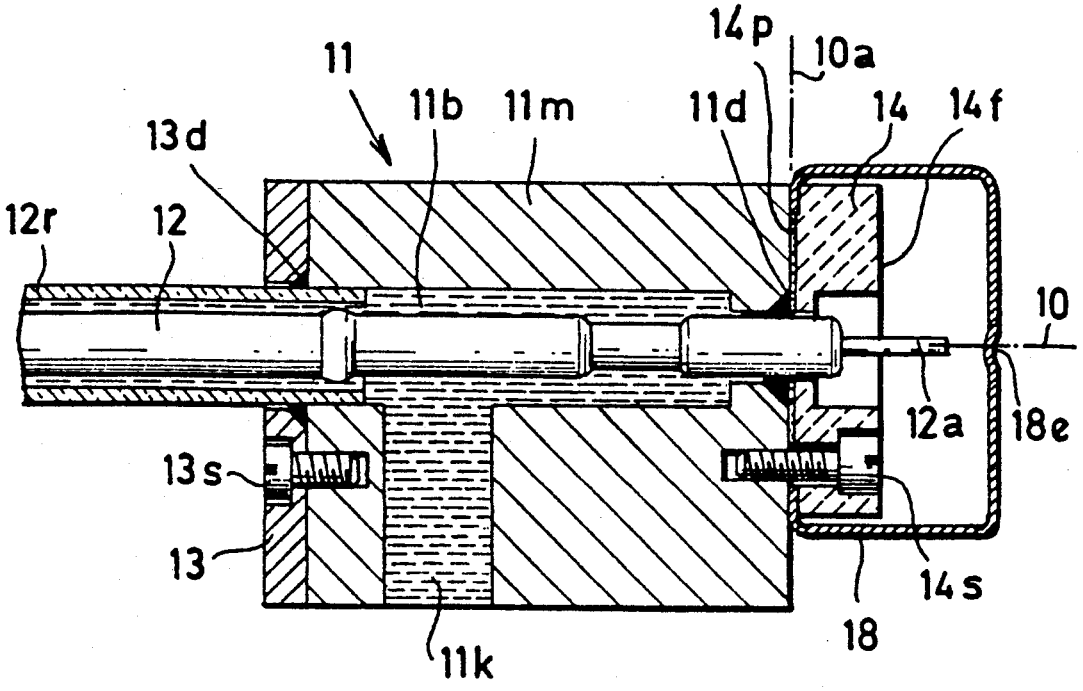
FIG. 1*a* is a side elevation view, partially in section, of an embodiment of the electric plug connector according to the invention wherein both connector components have a heat-contact surface defined by a material which is both insulating and a good conductor of heat.
Figure 1B:
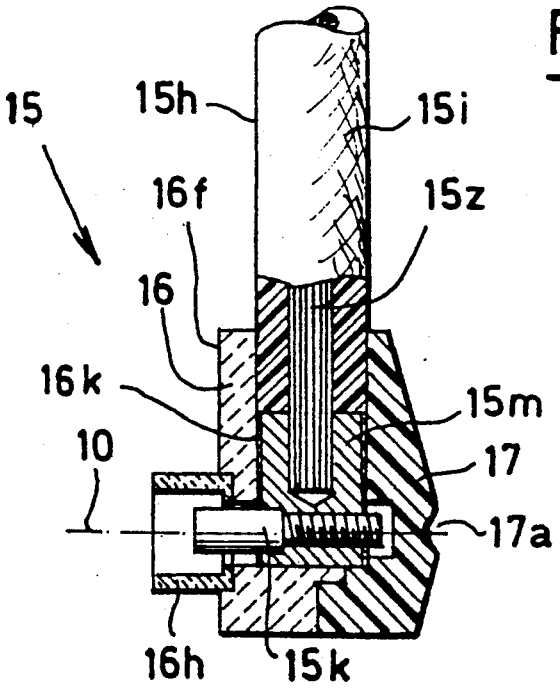
FIG. 1*b* is a side elevation view, partially in section, showing the electric receptacle and electric supply line for the gas discharge source.

In FIG. 1, reference numeral 11 identifies a cooled connector component comprising a metal part 11*m* having a bore 11*b* for a gas discharge source 12 and a further bore 11*k* for the cooling water. The cooling water flows through the pipe 12*r* along the gas discharge source 12 to its other end (not shown). The pipe 12*r* is seated in the bore 11*b* with some play and is held in the cooled connector component 11 by a sealing ring 13*d*. The sealing ring 13*d* is squeezed by a plate 13 attached with threaded fasteners 13*s* so that the sealing ring also provides a watertight connection between pipe 12*r* and metal part 11*m*.

The gas discharge source 12 is held at the other end of metal part 11*m* by the sealing ring 11*d* which provides a watertight connection by means of the plate 14 with the threaded fasteners 14*s*. The plate 14 is made of an electrically insulating and good heat-conductive material such as AlN from the ANCeram Company referred to above. A heat-conductive paste 14*p* is applied to provide the best possible heat-conductive contact between the plate 14 and the metal part 11*m* so that a small temperature difference at most can occur between the parts. The heat-conductive paste 14*p* can be obtained under product designation P 12 from the Wacker-Chemie Company of Munich in the Federal Republic of Germany.

A conventional contact receptacle 15*k* can be used for making the electrical connection with pin 12*a* of the gas discharge source 12. The contact receptacle 15*k* is threadably engaged in a metal part 15*m* (FIG. 1*b*) into which the electric supply line 15*z* is soldered. The insulation 15*i* of the supply line 15*z* has the same outer diameter as the metal part 15*m*. The metal part 15*m* and the contact receptacle 15*k* are connected to the molded part 16 and the molded part 16 is, in turn, made of an electrically insulating and good heat-conductive material. Preferably, the same material is used for molded part 16 as for the plate 14 of the cooled connector component. The parts (16 and 15*m*) are connected to each other with a heat-conductive adhesive 16*k* which can, for example, be STYCAST 2850 MT from the Emerson and Cuming Company of Heidelberg in the Federal Republic of Germany.

A sleeve 16*h* made of insulating material is seated in the molded part 16 of the movable connector component 15 and provides protection against touching for the contact receptacle 15*k*. The end of the connector component 15 which lies opposite the contact receptacle 15*k* is protected by a plastic cap 17 against touching the voltage-carrying parts.

An adequate cooling of the connecting pin 12*a* and the contact receptacle 15*k* is decisive for a reliable contact between these parts notwithstanding the heating of the electrode of the gas discharge source 12 and thereby also its connecting pin 12*a*. For this cooling, the heat transfer from the cooled connector component 11 to the movable connector component via the heat-contact surfaces (14*f* and 16*f*) is an essential factor. These surfaces must therefore be so processed that they provide a good contact with each other over their entire contact surfaces.

In optics, such surfaces are known as optically polished surfaces. They adhere to each other via adhesion when they are brought adequately close to each other. With other materials, too, such surfaces can be produced which adhere to each other by adhesion. The cooled connector component 11 is provided with a spring bracket 18 rotatable about the axis 10*a* which ensures that the heat-contact surfaces are brought together and also ensures a reliable contact thereof. The spring bracket 18 latches with its depression 18*e* into the cutout 17*a* of the plastic part 17 when the movable connector component 15 is seated. To prevent the cable 15*h* from colliding with the spring bracket 18, the movable component part 15 is rotated out of the plane of the drawing about the axis 10 at least somewhat and preferably approximately 90° when this component 15 is plugged in.

Figure 2A:
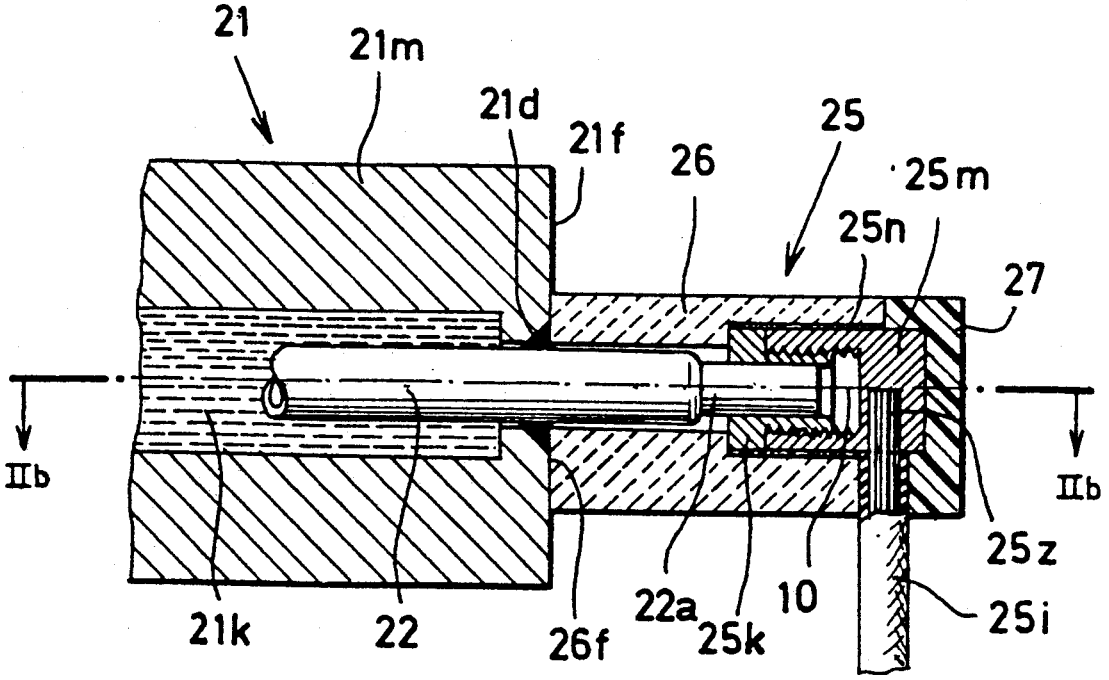
FIG. 2*a* is a side elevation view of another embodiment of the invention wherein only the insert component is made of a material which is both insulating and a good heat conductor; and, FIG. 2*b* shows how the molded part is attached to the metal part through which cooling water flows.
Figure 2B:
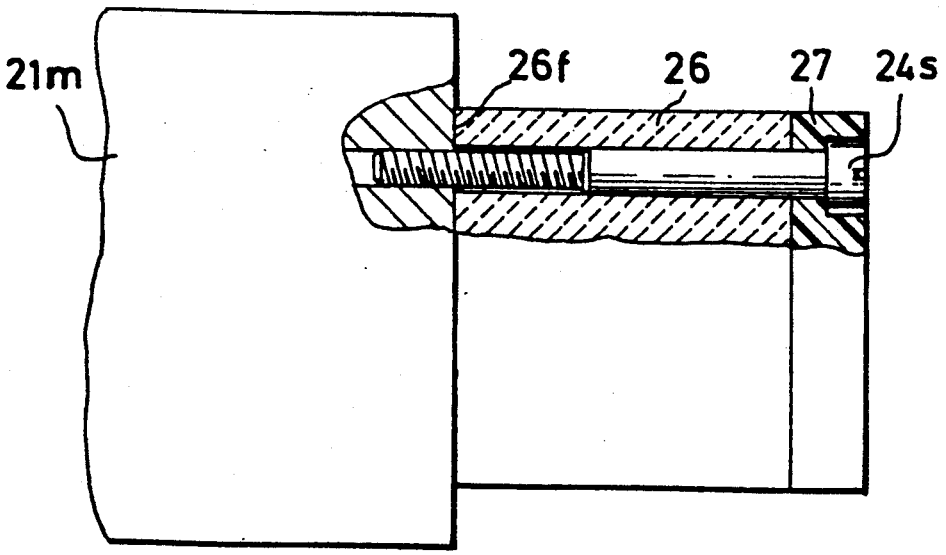

Another embodiment of the invention is shown in FIGS. 2*a* and 2*b*. In this embodiment, only one component is made of an insulating and good heat-conductive material, that is, the molded part 26. When the plug connector is put together, the heat-contact surface 26*f* of the molded part 26 is seated on the heat-contact surface 21*f* of the metal part 21*m* of the connector component cooled by the cooling water 21*k*.

The metal part 25*m* is glued into the molded part 26 with heat-conductive adhesive 25*n*. On the one hand, a commercially available contact receptacle 25*k* is threadably engaged in the metal part 25*m* and, on the other hand, the electrical supply line 25*z* is soldered into the metal part 25*m* and the insulating jacket of the line 25*z* is identified by reference numeral 25*i*. The plastic cap 27 again protects against touching.

When the connector component 25 is seated, the contact receptacle 25*k* surrounds the connector pin 22*a* of the gas discharge source 22 while at the same time, the surface 26*f* of the molded part 26 presses the sealing ring 21*d* in the metal part 21*m* such that a watertight seal is provided between the gas discharge source 22 and the metal part 21*m* through which cooling water 21*k* flows. The necessary pressing force for the seal is developed by the two threaded fasteners 24*s* of which one is shown in FIG. 2*b*. The dimensions of the sealing ring 21*d* and the cutout in the metal part 21*m* provided for the sealing ring are selected such that a trouble-free seal for the cooling water 21*k* results when the heat-contact surfaces (21*f* and 26*f*) are seated tightly against each other. Since these surfaces are optically polished, a good heat transfer from the cooled metal part 21*m* to the metal part 25*m* having the contact receptacle 25*k* takes place via the insulating and good heat-conductive molded part 26 so that the plug connection between the cooled connector component 21 and the movable connector component 25 defines a trouble-free electric connection notwithstanding the intense heat of the gas discharge source 22 and its connecting pin 22*a* even for a long operational service.

It is understood that in lieu of the gas discharge sources (12, 22) referred to in the embodiments, other current consumers can be used wherein cooling is advantageous or necessary. Likewise, the invention is in no manner restricted to a laser.

It is understood that the foregoing description is that of the preferred embodiments of the invention and that various changes and modifications may be made thereto without departing from the spirit and scope of the invention as defined in the appended claims.

What is claimed is:

1. An electric plug connector for an apparatus having cooling means for removing heat generated in the apparatus, the plug connector comprising:

a first component connected to the apparatus and including a heat-conductive non-deformable first part operatively connected to the cooling means, said heat-conductive non-deformable first part having a first heat-contact surface formed thereon;

first electrical contact means for conducting electrical energy to said apparatus;

a second component movable and adapted so as to be connectable to said first component and including a heat-conductive non-deformable second part made of an electrically-insulating and good heat-conductive material and said heat-conductive second part having a second heat-contact surface formed thereon;

said first and second heat-contact surfaces being in snug uninterrupted surface-to-surface mechanical contact with each other when said first and second components are connected to each other so as to conjointly define a heat-transfer interface having a low heat resistance for facilitating the transfer of heat across said interface;

said first part being configured so as to cause said first part to define a low heat resistance path between said first heat-contact surface and said cooling means;

second electrical contact means mounted in said second component for electrically contact engaging said first electrical contact means when said components are connected to each other; and, said second electrical contact means being connected to said heat-conductive second part so as to be in low heat resistance contact therewith and with said cooling means via a path conjointly defined by said second part, said heat-transfer interface and said first part so as to cool said second electrical contact means and said first electrical contact means when said first and second components are connected.

2. The electric plug connector of claim 1, said first part including a base part and an additional part defining said first heat-contact surface; and, said additional part being made of an electrically-insulating and good heat-conductive material having a low heat resistance.

3. The electric plug connector of claim 1, said plug connector defining a longitudinal axis and said first and second heat-contact surfaces being planar surfaces extending perpendicular to said axis.

4. The electric plug connector of claim 1, said electrically-insulating and good heat-conductive material being AlN.

5. The electric plug connector of claim 1, said electric plug connector further comprising mechanical holding means for applying a force between said components to hold said first and second heat-contact surfaces together.

6. An electric plug connector for an apparatus having cooling means for removing heat generated in the apparatus, the plug connector comprising:

a first component connected to the apparatus and including a heat-conductive first part operatively connected to the cooling means, said heat-conductive first part having a first heat-contact surface formed thereon;

first electrical contact means for conducting electrical energy to said apparatus;

a second component movable and adapted so as to be connectable to said first component and including a heat-conductive second part made of an electrically-insulating and good heat-conductive material and said heat-conductive second part having a second heat-contact surface formed thereon;

said first and second heat-contact surfaces being in mechanical contact with each other when said components are connected to each other so as to conjointly define a heat-transfer interface having a low heat resistance;

said first part being configured so as to cause said first part to define a low heat resistance path between said first heat-contact surface and said cooling means;

second electrical contact means mounted in said second component for electrically contact engaging said first electrical contact means when said components are connected to each other;

said second electrical contact means being connected to said heat-conductive second part so as to be in low heat resistance contact therewith; and, said first and second heat-contact surfaces being optically polished surfaces.

7. An electric plug connector for an apparatus having cooling means for removing heat generated in the apparatus, the plug connector comprising:

a first component mounted on the apparatus and including a heat-conductive non-deformable first part connected to the cooling means, said heat-conductive first part having first heat-contact surface means formed thereon;

first electrical contact means for conducting electrical energy to said apparatus;

a second component movable and adapted so as to be connectable to said first component and including a heat-conductive non-deformable second part made of an electrically-insulating and good heat-conductive material; and, said second part having second heat-contact surface means for transferring heat away from said second component;

said first and second heat-contact surface means being in snug uninterrupted surface-to-surface mechanical contact with each other when said components are connected to each other so as to conjointly define a heat-transfer interface having a low heat resistance for facilitating the transfer of heat across said interface;

said first part being configured so as to cause said first part to define a low heat resistance path between said first heat-contact surface means and said cooling means;

second electrical contact means mounted in said second component part for electrically contact engaging said first electrical contact means when said components are connected to each other; and, said second electrical contact means being connected to said heat-conductive second part so as to be in low heat resistance contact therewith and with said cooling means via a path conjointly defined by said second part, said heat-transfer interface and said first part so as to cool said second electrical contact means and said first electrical contact means when said first and second components are connected.

8. A pump source for a high-energy laser comprising:

a gas discharge source having an electrode which becomes heated during operation of the laser;

cooling means for cooling said gas discharge and said electrode;

said electrode having first electrical contact means for conducting electrical energy to said electrode; and, a plug connector including:

a first component connected to the apparatus and including a heat-conductive non-deformable first part operatively connected to the cooling means, said heat-conductive non-deformable first part having a first heat-contact surface formed thereon;

first electrical contact means for conducting electrical energy to said apparatus;

a second component movable and adapted so as to be connectable to said first component and including a heat-conductive non-deformable second part made of an electrically-insulating and good heat-conductive material and said heat-conductive second part having a second heat-contact surface formed thereon;

said first and second heat-contact surfaces being in snug uninterrupted surface-to-surface mechanical contact with each other when said first and second components are connected to each other so as to conjointly define a heat-transfer interface having a low heat resistance for facilitating the transfer of heat across said interface;

said first part being configured so as to cause said first part to define a low heat resistance path between said first heat-contact surface and said cooling means;

second electrical contact means mounted in said second component for electrically contact engaging said first electrical contact means when said components are connected to each other; and, said second electrical contact means being connected to said heat-conductive second part so as to be in low heat resistance contact therewith and with said cooling means via a path conjointly defined by said second part, said heat-transfer interface and said first part so as to cool said second electrical contact means and said first electrical contact means when said first and second components are connected.

* * * * *